US010895034B2

(12) United States Patent
Cho et al.

(10) Patent No.: US 10,895,034 B2
(45) Date of Patent: Jan. 19, 2021

(54) CLOTHES DRYER

(71) Applicant: LG ELECTRONICS INC., Seoul (KR)

(72) Inventors: Hongjun Cho, Seoul (KR); Byeongjo Ryoo, Seoul (KR); Youngjoo Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 35 days.

(21) Appl. No.: 16/283,623

(22) Filed: Feb. 22, 2019

(65) Prior Publication Data

US 2019/0264378 A1 Aug. 29, 2019

(30) Foreign Application Priority Data

Feb. 23, 2018 (KR) ..... 10-2018-0022086

(51) Int. Cl.
*D06F 58/06* (2006.01)
*D06F 58/08* (2006.01)
*D06F 58/04* (2006.01)

(52) U.S. Cl.
CPC ..... *D06F 58/06* (2013.01); *D06F 58/04* (2013.01); *D06F 58/08* (2013.01)

(58) Field of Classification Search
CPC ..... D06F 58/00; D06F 58/06; D06F 58/04; D06F 58/08; D06F 2222/00; D06F 2210/00; D06F 37/00
USPC ..... 34/595–610
See application file for complete search history.

(56) References Cited

U.S. PATENT DOCUMENTS 3,696,521 A * 10/1972 Hubbard ..... D06F 58/04 34/128
7,627,960 B2 * 12/2009 Beyerle ..... D06F 58/04 34/602
7,644,515 B2 * 1/2010 Doh ..... D06F 58/22 34/603
7,913,419 B2 * 3/2011 Tomasi ..... D06F 29/00 211/85.3
8,347,523 B2 * 1/2013 Chung ..... D06F 58/04 34/130
8,776,395 B2 * 7/2014 Tatar ..... D06F 39/14 34/242

(Continued)

FOREIGN PATENT DOCUMENTS

DE 112013007225 B4 * 7/2019 ..... D06F 31/00
EP 2902541 A1 8/2015

(Continued)

OTHER PUBLICATIONS

International Search Report from PCT/KR2019/001877, dated May 21, 2019.

(Continued)

*Primary Examiner* — Stephen M Gravini
(74) *Attorney, Agent, or Firm* — Dentons US LLP

(57) ABSTRACT

Disclosed herein is a clothes dryer. The clothes dryer includes a casing in which a first drum is provided, the casing being formed with an introduction opening of clothes, and a door provided at the casing to open or close the introduction opening, the door including a drum assembly. The drum assembly includes a second drum to be rotatable, so that clothes are introduced into and dried in the first and second drums.

20 Claims, 13 Drawing Sheets

(56) References Cited

U.S. PATENT DOCUMENTS

| | | | | |
|---|---|---|---|---|
| 9,765,471 | B2 * | 9/2017 | Kim | D06F 58/04 |
| 10,240,277 | B2 * | 3/2019 | Nam | D06F 58/24 |
| 10,280,546 | B2 * | 5/2019 | Kim | D06F 31/00 |
| 10,301,756 | B2 * | 5/2019 | Lv | D06F 31/00 |
| 10,316,449 | B2 * | 6/2019 | Jo | D06F 39/14 |
| 10,329,709 | B2 * | 6/2019 | Nam | D06F 58/24 |
| 10,487,436 | B2 * | 11/2019 | Jeong | D06F 39/088 |
| 10,570,558 | B2 * | 2/2020 | Um | D06F 58/10 |
| 10,570,559 | B2 * | 2/2020 | Heo | D06F 58/04 |
| 2015/0135777 | A1 | 5/2015 | Cho | |
| 2015/0211167 | A1 | 7/2015 | Kim et al. | |
| 2016/0160424 | A1 | 6/2016 | Kim et al. | |
| 2018/0119327 | A1 | 5/2018 | Kim et al. | |
| 2019/0177905 | A1 * | 6/2019 | Ayers | D06F 60/00 |
| 2019/0264378 | A1 * | 8/2019 | Cho | D06F 58/08 |

FOREIGN PATENT DOCUMENTS

| | | | | |
|---|---|---|---|---|
| EP | 3031969 | A1 | 6/2016 | |
| EP | 3530799 | A1 * | 8/2019 | D06F 58/06 |
| JP | 6179744 | B2 * | 8/2017 | D06F 31/00 |
| KR | 100701329 | B1 | 3/2007 | |
| KR | 1020120022364 | A | 3/2012 | |
| KR | 10-1592318 | B1 | 2/2016 | |
| KR | 1020160127682 | A | 11/2016 | |
| WO | WO-2019164189 | A1 * | 8/2019 | D06F 58/08 |

OTHER PUBLICATIONS

Written Opinion of the ISA from PCT/KR2019/001877, dated May 21, 2019.

Search Report of European Patent Office in Appl'n No. 19158850.8, dated Jun. 26, 2019.

* cited by examiner

CLOTHES DRYER

CROSS REFERENCE TO RELATED APPLICATION

The present application claims priority to Korean Patent Application No. 10-2018-0022086, filed on Feb. 23, 2018, the entire contents of which is incorporated herein for all purposes by this reference.

BACKGROUND OF THE INVENTION

1. Field of the Invention

The present invention relates to a clothes dryer.

2. Discussion of the Related Art

Generally, a clothes dryer is a device that dries clothes by blowing hot air into a drum, into which wet clothes have been introduced. Such a clothes dryer may be divided into an exhaust-type dryer and a condensing-type dryer according to a method of processing humid air discharged from the drum after drying the clothes.

In the exhaust-type dryer, the air heated by a heater is supplied into the drum so that the clothes are dried, and the humid air discharged from the drum is exhausted to the outside of the dryer. This method does not require a separate device in order to condense the moisture removed from the clothes since the moisture is discharged, along with the air, to the outside of the dryer.

In the condensing-type dryer, the air heated by the heater circulates along a circulation flow-path, which is configured to pass through the drum, and the moisture contained in the air is condensed or removed in the circulation process.

These conventional clothes dryers have no ability to separate and dry the clothes since the space in which the clothes are accommodated is limited to the drum. In some cases, a user may need to arbitrarily separate and dry the clothes. For example, in the case of delicate clothes such as underwear or baby goods, ordinary users do not prefer to mix them with other clothes. However, since the conventional clothes dryers have no ability to separate and dry the clothes, it may be necessary for the user to introduce only the delicate clothes into the drum, dry the clothes, and remove the clothes from the drum, and thereafter to operate the clothes dryer again in order to dry other clothes.

In addition, the drying rate of clothes depends on the material of clothes. Thus, in the case in which clothes of a material that dries quickly and clothes of a material that dries relatively slowly are both introduced into the drum, the clothes of the material that dries quickly may be in the excessively dried state compared to the other clothes, after the completion of drying all the clothes inside the drum. Therefore, it may be necessary to stop the operation of the dryer and remove the clothes of the material that dries quickly before the drying operation is completed. However, in the conventional clothes dryers, since all the clothes are mixed in the drum, the user needs to select and remove the completely dried clothes manually.

PRIOR ART DOCUMENT

Patent Document

1. Registration Number (Date of Registration): 10-1592318 (Feb. 1, 2016)
2. Title of Invention: Dryer

SUMMARY OF THE INVENTION

An object of the present invention devised to solve the above-described problems is to provide a clothes dryer capable of introducing clothes that need to be separated and dried into a sub drum, rather than a main drum, and performing drying on the clothes.

In addition, another object of the present invention is to provide a clothes dryer capable of enhancing the drying efficiency of clothes by realizing a change in the position of clothes introduced into a sub drum via rotation of the sub drum.

In addition, another object of the present invention is to provide a clothes dryer including a drive device and a power transmission device in order to enable a sub drum to be stably rotated.

In addition, another object of the present invention is to provide a clothes dryer capable of preventing lint or moisture inside a sub drum from leaking to the outside through a space between the sub drum and a cover.

In addition, a further object of the present invention is to provide a clothes dryer capable of realizing easy drying of clothes, more particularly, shoes.

To achieve the above objects, a clothes dryer according to an embodiment includes a casing in which a first drum is provided, the casing being formed with an introduction opening of clothes, and a door provided at the casing to open or close the introduction opening, the door including a drum assembly, wherein the drum assembly includes a second drum to be rotatable, whereby the clothes may be introduced into and dried in the first and second drums.

The clothes dryer further includes a first cover disposed at a first side of the second drum and provided with a first roller device configured to guide rotation of the second drum.

The clothes dryer further includes a second cover disposed at a second side of the second drum and provided with a second roller device configured to guide the rotation of the second drum. Thus, with the first and second roller devices, the rotation of the second drum may be smoothly performed.

The clothes dryer may further include a clothes treatment space defined by an inner space of the second drum and the first cover. Thus, the drying capacity of the clothes dryer may be increased.

The first cover may include a first cover body formed with a through-hole for communicating an inner space of the first drum with the clothes treatment space, and a cover door coupled to the first cover body to open or close the clothes treatment space. Thus, it is easy to introduce the clothes into the second drum.

The first cover body and the cover door may be formed of a transparent material. Thus, it is possible to easily view the inside of the first drum.

The first cover body may further include a first roller support portion configured to support the first roller device, and the first roller device may include a plurality of first roller devices disposed on the first roller support portion, the plurality of first roller devices being spaced apart from each other in a circumferential direction. Thus, it is easy to operate the first roller device.

The second drum may include a drum body having a cylindrical shape and including an opened rear portion, and the first cover may be coupled to the opened rear portion. Thus, it is easy to form the clothes treatment space.

The drum body and a front-surface portion of the door may be formed of a transparent material. Thus, it is possible to easily view the inside of the second drum.

The clothes dryer may further includes a drum drive device configured to provide the second drum with rotating force, the drum drive device including a motor and one or more gear members.

In addition, the clothes dryer further includes a rack provided on an outer peripheral surface of the drum body and interlocked with the gear members. Thus, the rotation of the second drum may be smoothly performed.

The clothes dryer may further include a rolling guide provided on the outer peripheral surface of the drum body and on which the first and second roller devices are contactable, and the rolling guide may be disposed at opposite sides of the rack.

The first roller device or the second roller device may include a roller configured to perform rolling on an outer peripheral surface of the rolling guide, and a roller shaft coupled to the roller.

The first roller device or the second roller device may include a sliding rail coupled to the roller shaft and disposed so as to be contactable with a guide side-surface portion that defines a thickness of the rolling guide. Thus, it is possible to prevent the second drum from vibrating in the longitudinal direction thereof.

The first cover or the second cover may include two roller support portions configured to accommodate therein the roller and the sliding rail, and the roller shaft may penetrate the roller and the sliding rail and extend in opposite directions of the two roller support portions. Thus, it is possible to prevent separation of the first and second roller devices.

The second cover may be disposed so as to surround an outer peripheral surface of the second drum, and the second roller device may be disposed on an inner peripheral surface of the second cover.

The second cover may be formed with a gear accommodating portion, into which an intermediate gear is inserted in order to guide the rotation of the second drum, and the intermediate gear may include an upper portion that is interlocked with a rack provided on the second drum. Thus, it is easy to arrange the power transmission device for driving the drum.

The clothes dryer further includes a sealing member coupled to the opened rear portion of the second drum and configured to seal the clothes treatment space. Thus, it is possible to prevent moisture or a foreign substance from being discharged to the outside from the clothes treatment space.

The clothes dryer may further include a protrusion provided on an upper portion of the cover door and configured to be caught by the cover body, and the cover door may be a pull-down opening door that is opened by downward rotation of the upper portion of the cover door with respect to a lower portion of the cover door. Thus, it is easy to open the cover door, and it is possible to effectively dry, for example, shoes using the inner surface of the cover door.

DETAILED DESCRIPTION OF THE PREFERRED EMBODIMENTS

Exemplary embodiments of the present invention will be described below in detail with reference to the accompanying drawings. However, it is to be understood that the spirit of the present invention is not limited to the embodiments disclosed herein and that those skilled in the art who understand the spirit of the present invention may easily propose other embodiments within the scope of the same spirit.

Figure 1:
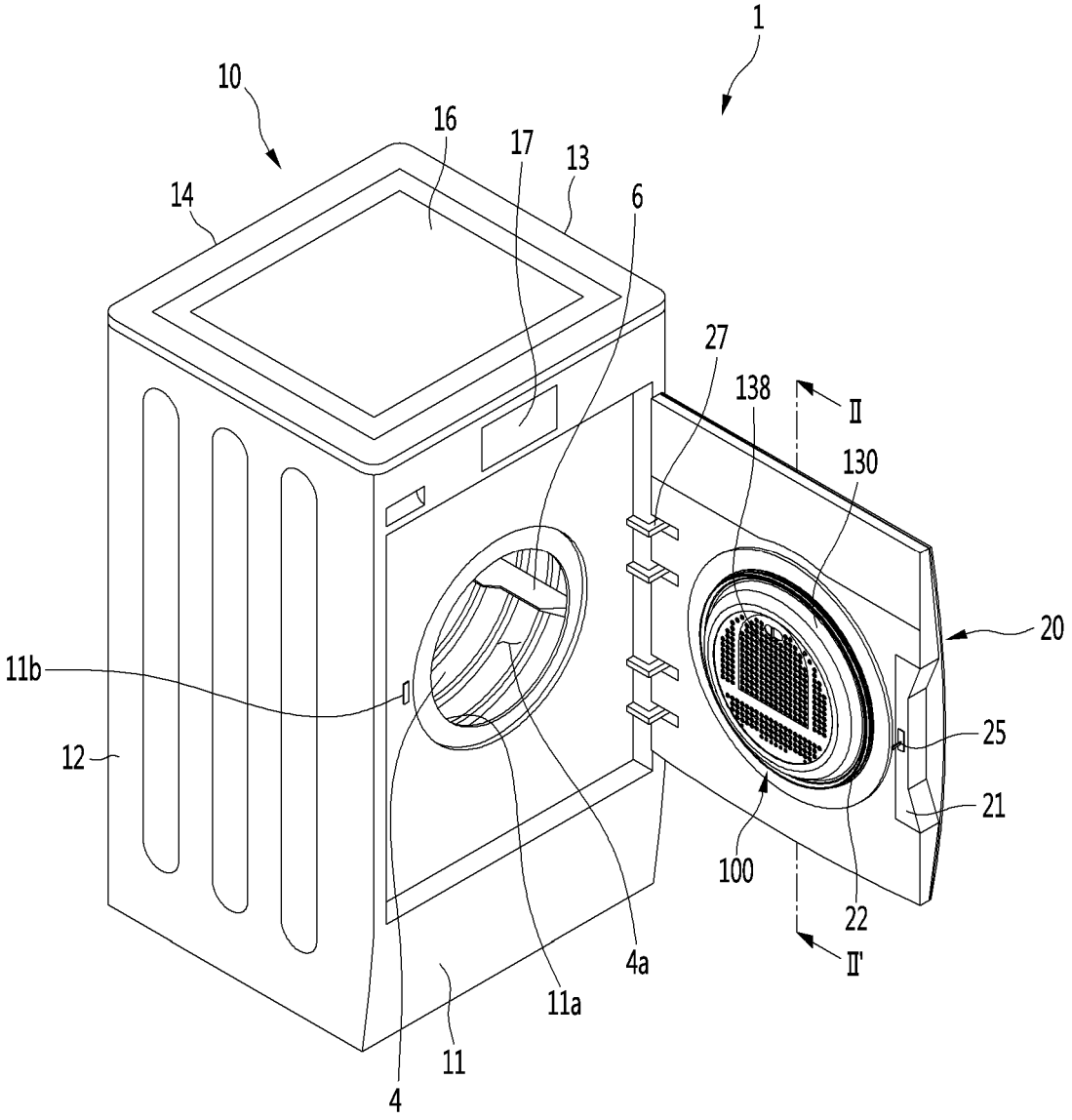
FIG. 1 is a perspective view illustrating the configuration of a clothes dryer according to an embodiment of the present invention.

FIG. 1 is a perspective view illustrating the configuration of a clothes dryer according to an embodiment of the present invention.

Referring to FIG. 1, the clothes dryer 1 according to the embodiment of the present invention includes a casing 10 defining the external appearance of the clothes dryer 1. The casing 10 has a substantially rectangular parallelepiped shape, and includes multiple plates.

The multiple plates include a base, a front plate 11 extending upward from a front portion of the base, and a left plate 12 and a right plate 13 extending upward respectively from opposite sides of the base. The left plate 12 and the right plate 13 may extend rearward from opposite sides of the front plate 11.

The multiple plates include a top plate 16 provided at the upper side of the left plate 12 and the right plate 13 and a back plate 14 provided at the rear side of the left plate 12 and the right plate 13.

A space in which a main drum 4 is provided is defined inside the multiple plates. The main drum 4 defines therein a first clothes treatment space 4*a* in which clothes are dried. The main drum 4 is rotatable.

A lifter 6 may be provided on the inner peripheral surface of the main drum 4 in order to raise the clothes during a drying process. The lifter 6 may protrude from the inner peripheral surface of the main drum 4, and may extend lengthwise in the longitudinal direction. Here, a plurality of lifters 6 may be provided. With the lifters 6, the clothes may be repeatedly raised and lowered.

A control panel 17 may be disposed on the upper region of the front plate 11. The control panel 17 may be provided with a display (e.g., an LCD or LED panel), which displays the operating state of the clothes dryer 1, and an input unit (e.g., a button, a dial, or a touchscreen), which receives an operation command for the clothes dryer from a user.

The front plate 11 is formed with an introduction opening 11*a*, through which the cloths are introduced into the main drum 4. In one example, the introduction opening 11*a* may be configured to have a circular shape.

The clothes dryer 1 further includes a door 20 capable of opening or closing the introduction opening 11*a*. The door 20 may be provided in front of the front plate 11, and may be rotatably coupled to the front plate 11 via a hinge device 27. The hinge device 27 may be provided on one lateral side of the front plate 11.

The door 20 includes a door frame 21 defining an opening 22 and a drum assembly 100 provided in the opening 22. The opening 22 may be formed at a position corresponding to the introduction opening 11*a* in the front plate 11, and may be formed to have substantially the same size as the introduction opening 11*a*.

The door frame 21 is provided with a latch 25, which may be separably coupled to a latch coupler 11*b* of the front plate 11. The latch 25 may be provided on the other lateral side of the front plate 11. In one example, one lateral side of the front plate 11, on which the hinge device 27 is provided, may form a "right side", and the other lateral side of the front plate 11, on which the latch 25 is provided, may form a "left side".

The latch coupler 11*b* may be disposed at the lateral side of the introduction opening 11*a*, and may be provided at a position corresponding to the latch 25 when the door 20 is closed.

The drum assembly 100 includes a first cover 130 disposed so as to suit to the introduction opening 11*a* when the door 20 is closed. In one example, the first cover 130 may be configured so as to be inserted into the introduction opening 11*a*, or may be configured so as to be disposed close to the introduction opening 11*a*.

The first cover 130 includes a cover door 138 to be openable. When the cover door 138 is opened, the clothes may be introduced into a sub drum 110, which is a component of the drum assembly 100.

The first cover 130 is formed with a through-hole 132. Here, a plurality of through-holes 132 may be formed, and the inner space (first clothes treatment space 4*a*) of the main drum 4 and the inner space (second clothes treatment space 112, see FIG. 2) of the sub drum 110 may communicate with each other through the plurality of through-holes 132.

Hereinafter, the drum assembly 100 will be described in more detail with reference to the accompanying drawings.

Figure 2:
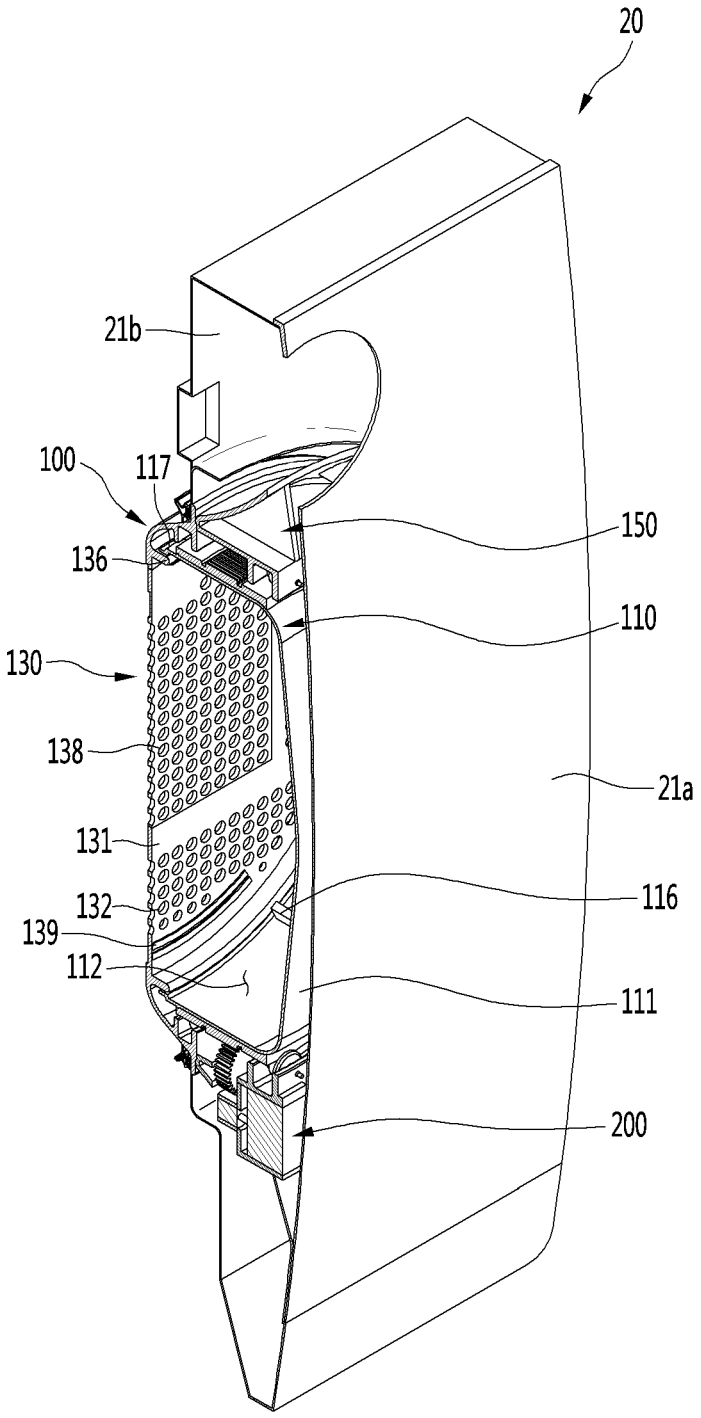
FIG. 2 is a cross-sectional view taken along line II-II' of FIG. 1.
Figure 3:
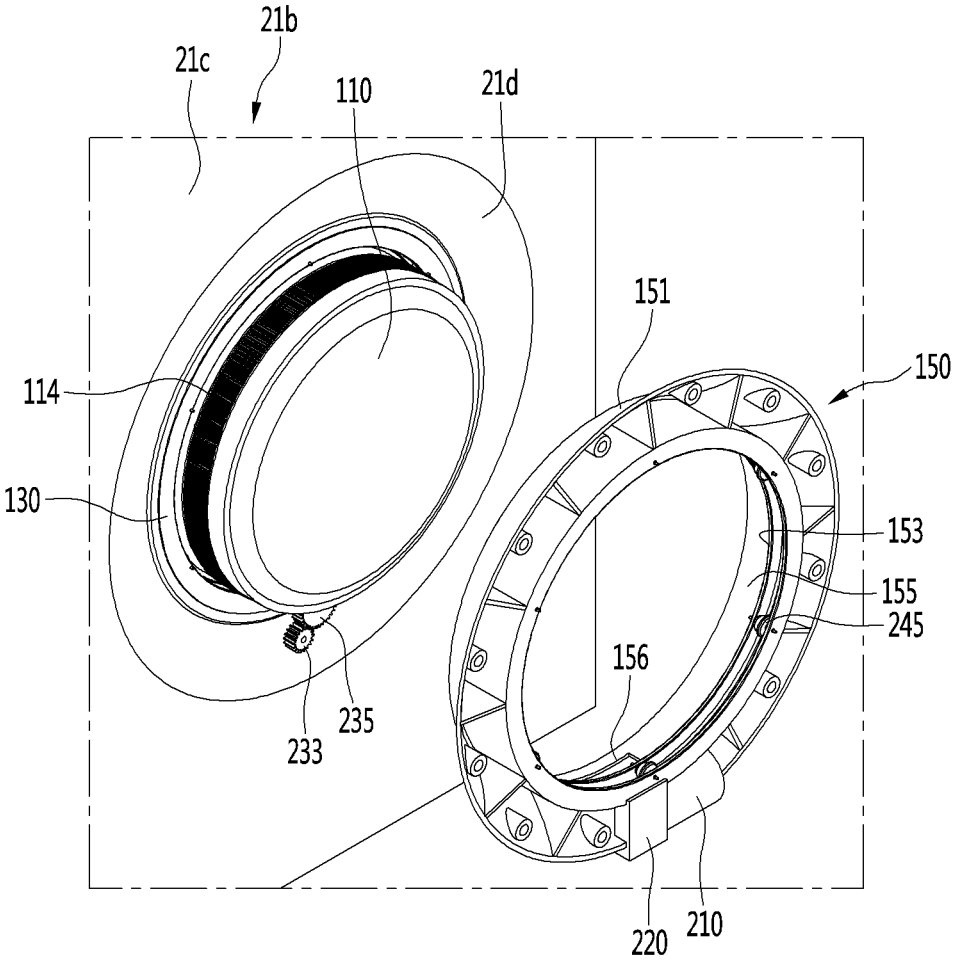
FIG. 3 is an exploded perspective view illustrating the configuration of a door according to the embodiment of the present invention.
Figure 4:
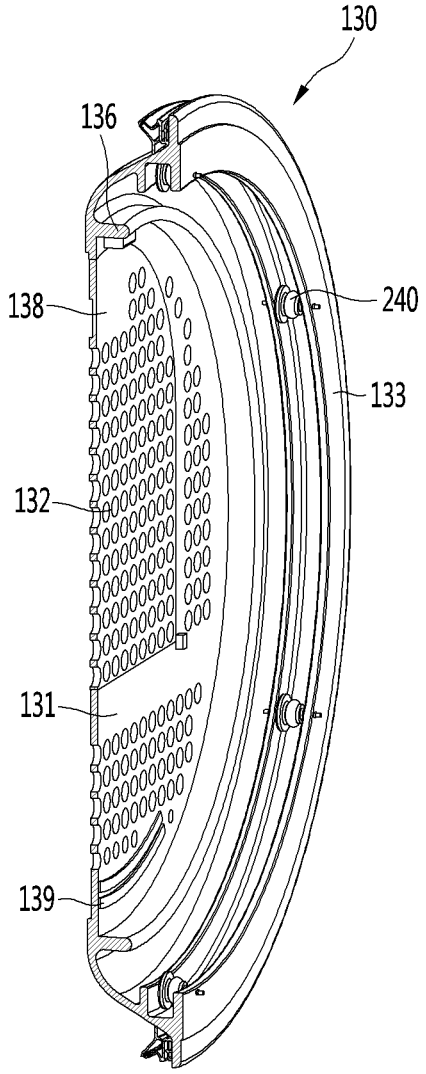
FIG. 4 is a cross-sectional view illustrating the configuration of a first cover according to the embodiment of the present invention.
Figure 5:
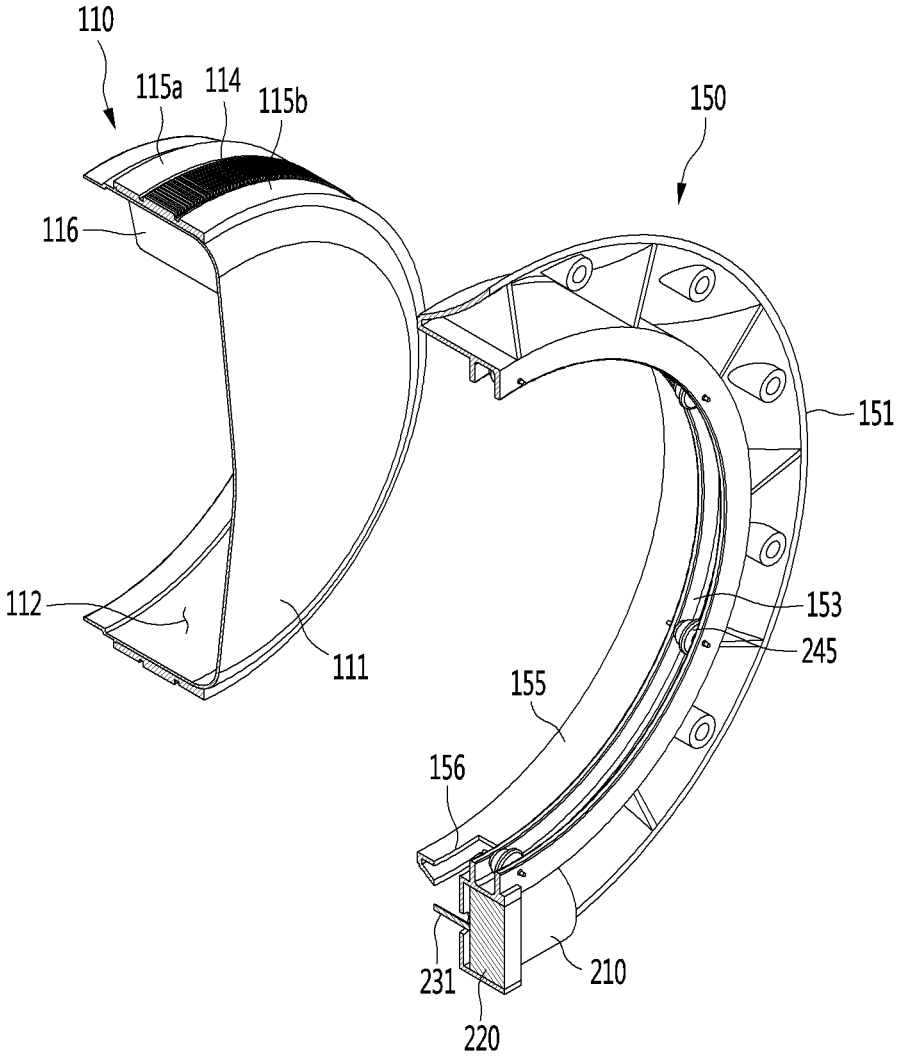
FIG. 5 is an exploded cross-sectional view illustrating the configuration of a sub drum and a second cover according to the embodiment of the present invention.

FIG. 2 is a cross-sectional view taken along line II-II' of FIG. 1, FIG. 3 is an exploded perspective view illustrating the configuration of the door according to the embodiment of the present invention, FIG. 4 is a cross-sectional view illustrating the configuration of the first cover according to the embodiment of the present invention, and FIG. 5 is an exploded cross-sectional view illustrating the configuration of the sub drum and a second cover according to the embodiment of the present invention.

Referring to FIGS. 2 to 5, the door frame 21 according to the embodiment of the present invention includes a door front-surface portion 21*a* defining the external appearance of the front surface of the door 20. The door front-surface portion 21*a* may be formed of a transparent material in order to allow the first clothes treatment space 4*a* in the main drum 4 and the second clothes treatment space 112 in the sub drum 110 to be visible.

The door frame 21 further includes a door rear-surface portion 21*b* coupled to the back of the door front-surface portion 21*a*. The door rear-surface portion 21*b* may form at least a portion of the external appearance of the rear surface of the door 20.

The drum assembly 100 may be coupled to the opening 22 in the door frame 21. At least a portion of the drum assembly 100 may be located in the inner space of the door 20 defined between the door front-surface portion 21*a* and the door rear-surface portion 21*b*. That is, the drum assembly 100 may be coupled to the opening 22 so as to extend forward, and may be located in the inner space of the door 20.

The drum assembly 100 includes the sub drum 110 to be rotatable. The sub drum 110 is a component that defines, along with the main drum 4, the drying space of the clothes dryer 1. Through the provision of the sub drum 110, the overall drying capacity of the clothes dryer 1 may be increased. For the convenience of description, the main drum 4 may be referred to as a "first drum" and the sub drum 110 may be referred to as a "second drum".

The sub drum 110 includes a drum body 111 having a substantially cylindrical shape, the drum body 111 defining therein the second clothes treatment space 112. A front portion of the drum body 111 may be closed and form a smooth surface, and a rear portion of the drum body 111 may be opened. The drum body 111 may be formed of a transparent material in order to allow the first clothes treatment space 4*a* in the main drum 4 and the second clothes treatment space 112 in the sub drum 110 to be visible.

A door lifter 116 may be provided on the inner peripheral surface of the drum body 111 in order to raise the clothes during a drying process. The door lifter 116 may protrude from the inner peripheral surface of the drum body 111, and may extend lengthwise in the longitudinal direction. Here, a plurality of door lifters 116 may be provided. With the door lifters 116, the clothes may be repeatedly raised and lowered.

The rear portion 117 of the drum body 111 may be formed so as to be open rearward, and may be disposed so as to surround the outer periphery of a guide rib 136 of the first cover 130. In one example, the rear portion 117 of the drum body 111 may have a ring shape.

The drum assembly 100 further includes the first cover 130 provided at the back of the sub drum 110, the first cover body 130 being coupled to the opened rear portion 117 of the drum body 111. It can be understood that the second clothes treatment space 112 is defined by the coupling of the sub drum 110 and the first cover 130.

The first cover 130 includes a first cover body 131, which has a substantially disc shape and closes the opened rear portion 117 of the drum body 111, and the cover door 138, which is rotatably coupled to the first cover body 131 and is capable of selectively opening or closing the second clothes treatment space 112. The cover door 138 may be opened in a pull-down manner in which an upper portion of the cover door 130 rotates downward.

That is, it can be understood that the first cover body 131 is formed with an introduction opening of the clothes and the cover door 138 is a component that opens or closes the introduction opening in the first cover body 131.

The first cover body 131 and the cover door 138 may be formed of a transparent material in order to allow the first clothes treatment space 4*a* in the main drum 4 to be visible.

In summary, the door front-surface portion 21*a*, the drum body 111, and the first cover 130 are formed of a transparent material in order to allow the first clothes treatment space 4*a* in the main drum 4 or the second clothes treatment space 112 in the sub drum 110 to be visible. Thus, the user can easily check a clothes drying process or the drying state of clothes.

The first cover body 131 and the cover door 138 may be formed with the through-holes 132, which communicate the first clothes treatment space 4*a* and the second clothes treatment space 112 with each other. Thus, the dry air that is present in the main drum 4 may be supplied into the sub drum 110 through the through-holes 132.

The first cover 130 may be provided with a dryness sensor 139, which is capable of sensing the degree of dryness of clothes. The dryness sensor 139 may be disposed on a lower portion of the first cover body 131, and may include one or more electrodes.

The first cover 130 may be provided with a first roller device 240, which is a component of a drum drive device 200 and guides the rotation of the sub drum 110. The first roller device 240 may be contactable with the outer peripheral surface of the sub drum 110. Here, a plurality of first roller device 240 may be provided.

The first cover 130 further includes a first roller support portion 133 supporting the first roller device 240. The first roller device 240 may be rotatably supported on the first roller support portion 133. The first roller support portion 133 may have a ring shape, and the plurality of first roller devices 240 may be disposed on the inner peripheral surface of the first roller support portion 133 and may be spaced apart from each other in the circumferential direction.

The first cover 130 further includes the guide rib 136 protruding forward from the first cover body 131. The guide rib 136 may be configured to have a ring shape. In addition, the guide rib 136 may be disposed so as to be located on the inner peripheral surface side of the rear portion 117 of the drum body 111. Through the configuration of the guide rib 136 and the rear portion 117 of the drum body 111 described above, the second clothes treatment space 112 may be easily configured to have a cylindrical shape.

The drum assembly 100 further includes a second cover 150 provided at the outer periphery of the sub drum 110 to guide the rotation of the sub drum 110.

The second cover 150 may be configured so as to be seated on a cover seating portion 21*d*, which is formed on the door rear-surface portion 21*b*. The cover seating portion 21*d* may be formed in the circumferential direction along the outer periphery of the sub drum 110, and may be recessed rearward in a rear-surface-portion body 21*c* of the door rear-surface portion 21*b* so that a rear portion of the second cover 150 may be seated therein.

The second cover 150 includes a second cover body 151 placed on the cover seating portion 21*d*, the second cover body 151 being disposed to surround the outer peripheral surface of the sub drum 110. The second cover body 151 may have a ring shape.

The clothes dryer 1 further includes the drum drive device 200, which provides drive force required to rotate the sub drum 110 and guides the rotation of the sub drum 110.

The drum drive device 200 includes a motor 210 provided on the second cover 150 to generate drive force. In one example, the motor 210 may be disposed on a lower portion of the second cover body 151.

The drum drive device 200 may include a second roller device 245 provided on the second cover 150 to guide the rotation of the sub drum 110. The second roller device 245 may be contactable with the outer peripheral surface of the sub drum 110, and may be disposed on the inner peripheral surface of the second cover 150. Here, a plurality of second roller devices 245 may be provided.

The second cover 150 further includes a second roller support portion 153 supporting the second roller device 245. The second roller device 245 may be rotatably supported on the second roller support portion 153. The second roller support portion 153 may have a ring shape, and the plurality of second roller devices 245 may be disposed on the inner peripheral surface of the second roller support portion 153 and may be spaced apart from each other in the circumferential direction.

The second cover 150 further includes a protruding portion 155 protruding rearward from the second roller support portion 153. The protruding portion 155 may be configured so as to extend in the circumferential direction and have a ring shape. It can be understood that the protruding portion 155 and the second roller support portion 153 are components of the second cover body 151.

The drum drive device 200 further includes a speed reducer 220 coupled to the motor 210 to reduce the rotational speed of the motor 210, and a motor shaft 231 connected to the speed reducer 220. The motor shaft 231 may extend rearward from the speed reducer 220.

The drum drive device 220 further includes a motor gear 233 coupled to the motor shaft 231, and an intermediate gear 235 interlocked with the motor gear 233. The motor gear 233 and the intermediate gear 235 may be collectively referred to as "gear members".

The motor gear 233 and the intermediate gear 235 may be meshed with each other, and the intermediate gear 235 may be interlocked with a rack 114 of the sub drum 110. A plurality of gear teeth provided on the intermediate gear 235 may be engaged with a plurality of gear teeth provided on the rack 114.

The protruding portion 155 of the second cover 150 may include a gear accommodating portion 156 in which the intermediate gear 235 is located. The gear accommodating portion 156 may be formed in at least a portion of the protruding portion 155 so as to vertically penetrate the protruding portion 155, and at least a portion of the intermediate gear 235 may be disposed so as to be inserted into the gear accommodating portion 156. An upper portion of the intermediate gear 235 may protrude into the upper region of the gear accommodating portion 156 and may be located outside the sub drum 110.

The sub drum 110 includes the rack 114 interlocked with the intermediate gear 235. The rack 114 may be provided on the outer peripheral surface of the drum body 111, and may extend in the circumferential direction. That is, the rack 114 may be disposed in a ring shape.

The sub drum 110 includes rolling guides 115*a* and 115*b*, which are contactable with the first roller device 240 and the second roller device 245 respectively. The rolling guides 115*a* and 115*b* may be provided on the outer peripheral surface of the sub drum 110, and may be disposed at opposite sides of the rack 114.

Specifically, the rolling guides 115*a* and 115*b* include a first rolling guide 115*a* disposed at one side of the rack 114 and on which the first roller device 240 is contactable, and a second rolling guide 115*b* disposed at the other side of the rack 114 and on which the second roller device 245 is contactable. The first and second rolling guides 115*a* and 115*b* may respectively have a ring shape.

Figure 6:
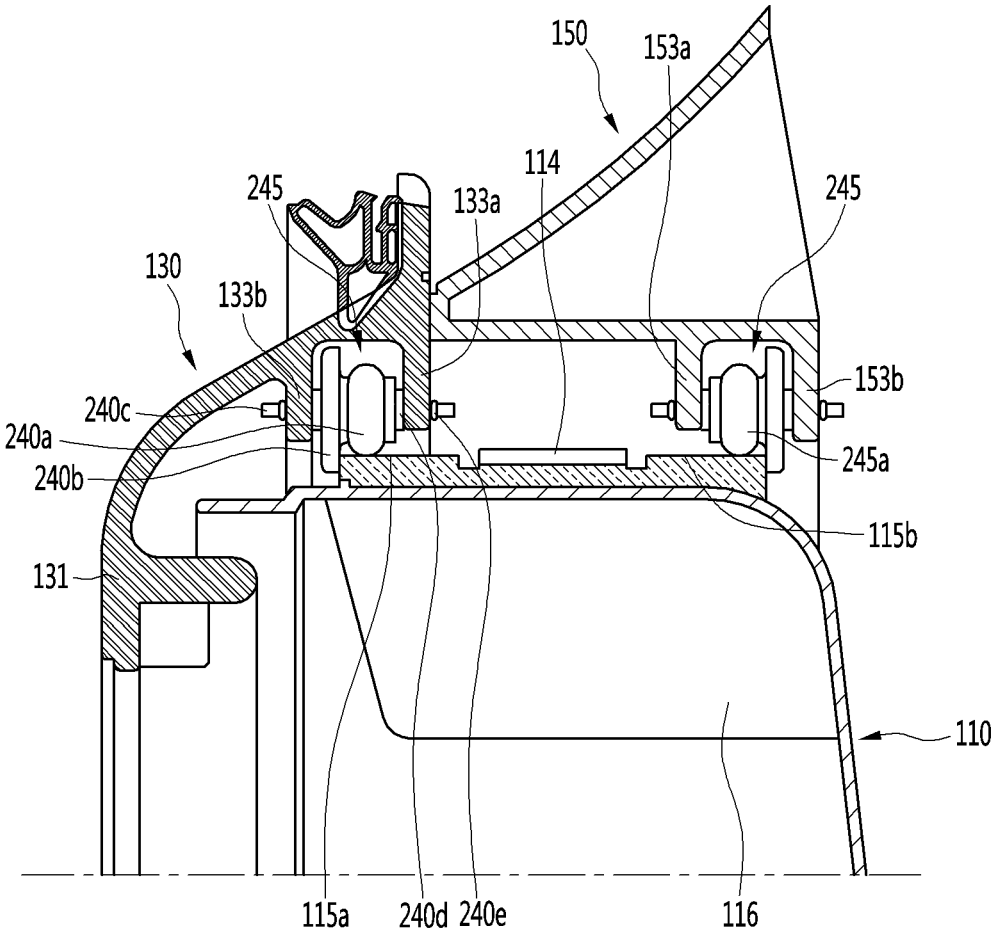
FIG. 6 is a cross-sectional view illustrating the partial configuration of a drum assembly according to the embodiment of the present invention.
Figure 7:
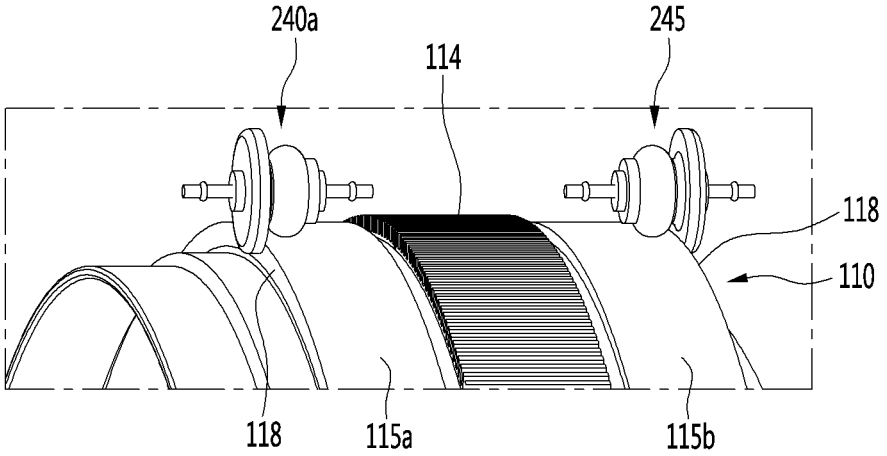
FIG. 7 is a view illustrating the configuration of the sub drum and roller devices according to the embodiment of the present invention.
Figure 8:
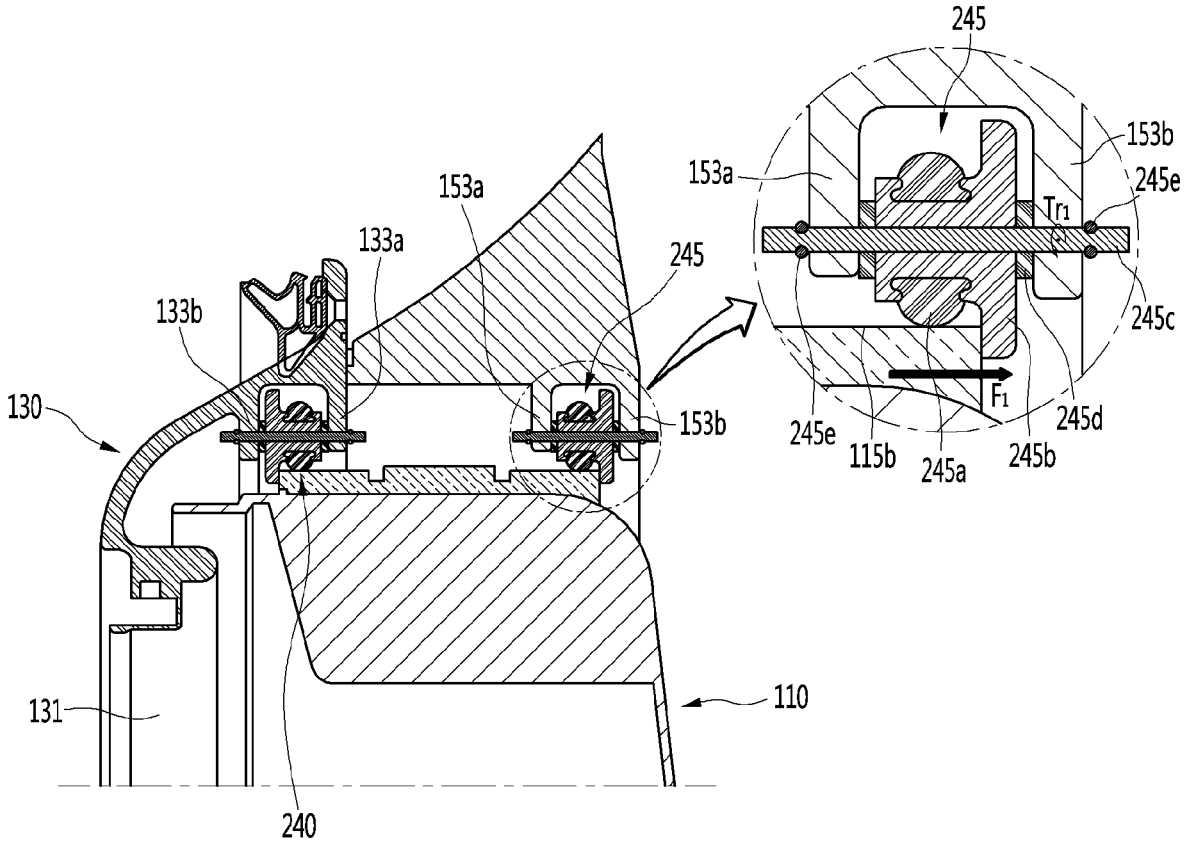
FIG. 8 is a cross-sectional view illustrating the configuration of the roller device according to the embodiment of the present invention.
Figure 9:
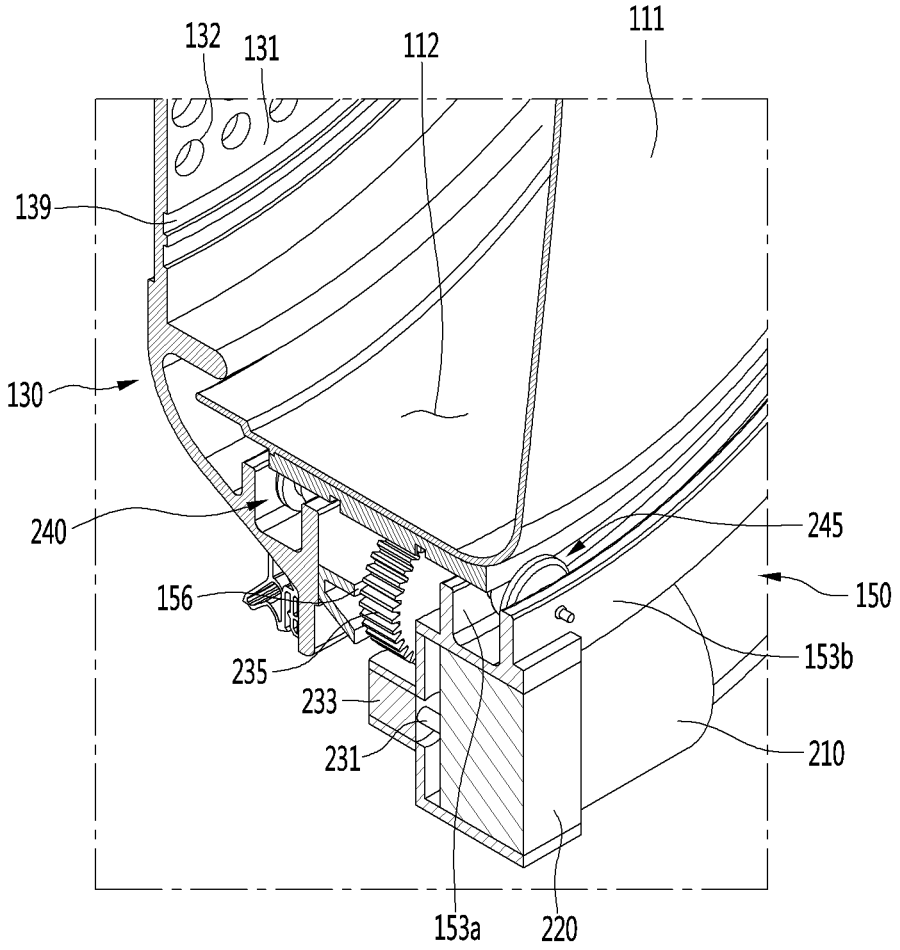
FIG. 9 is a cross-sectional view illustrating the configuration of a drum drive device according to the embodiment of the present invention.
Figure 10:
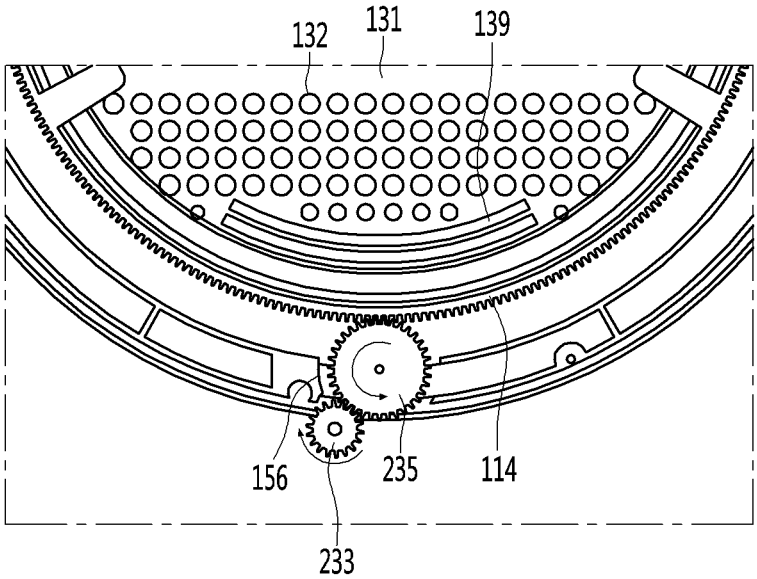
FIG. 10 is a view illustrating the interlocked state of a rack and a gear according to the embodiment of the present invention.

FIG. 6 is a cross-sectional view illustrating the partial configuration of the drum assembly according to the embodiment of the present invention, FIG. 7 is a view illustrating the configuration of the sub drum and the roller devices according to the embodiment of the present invention, FIG. 8 is a cross-sectional view illustrating the configuration of the roller device according to the embodiment of the present invention, FIG. 9 is a cross-sectional view illustrating the configuration of the drum drive device according to the embodiment of the present invention, and FIG. 10 is a view illustrating the interlocked state of the rack and the gear according to the embodiment of the present invention.

Referring to FIGS. 6 to 10, the drum assembly 100 according to the embodiment of the present invention includes the first roller device 240 supported on the first cover 130 in a rolling manner, and the second roller device 245 supported on the second cover 150 in a rolling manner.

The first roller device 240 may be coupled to the first roller support portion 133 of the first cover 130. The first roller support portion 133 includes a first support portion 133*a* supporting one side of the first roller device 240, and a second support portion 133*b* supporting the other side of the second roller device 240. The first and second support portions 133*a* and 133*b* may be spaced apart from each other, and a first roller 240*a* of the first roller device 240 may be disposed in the space between the first and second support portions 133*a* and 133*b*.

Specifically, the first roller device 240 includes the first roller 240*a* supported on the first rolling guide 115*a* in a contactable manner, and a first roller shaft 240*c* coupled to the first roller 240*a*.

In one example, the first roller shaft 240*c* may penetrate the first roller 240*a* and extend in opposite directions of the first roller 240*a*. Then, one end of the first roller shaft 240*c* may be coupled to the first support portion 133*a*, and the other end of the first roller shaft 240*c* may be coupled to the second support portion 133*b*. Both the ends of the first roller shaft 240*c* may protrude in opposite directions from the first and second support portions 133*a* and 133*b*.

The first roller device 240 further includes a first sliding rail 240*b*, which prevents the sub drum 110 from vibrating in the longitudinal direction during the rotation of the sub drum 110, thereby guiding smooth rotation of the sub drum 110.

The first sliding rail 240*b* may have a disc shape, and may be disposed in such a manner that the first roller shaft 240*c* penetrates the first sliding rail 240*b*. Then, the first roller 240*a* may be disposed so as to be fitted at the outer side of the first sliding rail 240*b*.

The first sliding rail 240*b* may be disposed in the space between the first and second support portions 133*a* and 133*b*, which are spaced apart from each other, and may be disposed so as to be contactable with a side-surface portion of the first rolling guide 115*a*. That is, the first roller 240*a* may be disposed in a rolling manner on the outer peripheral surface of the first rolling guide 115*a*, and the first sliding rail 240*b* may be disposed so as to be contactable with a guide side-surface portion 118, which defines the thickness of the first rolling guide 115*a*.

The first roller device 240 further includes a washer 240*d*, which is provided at either side of the first sliding rail 240*b*. The washer 240*d* may be disposed in the space between the first and second support portions 133*a* and 133*b*, which are spaced apart from each other, and may guide the first sliding rail 240*b* so as to be firmly coupled to the first and second support portions 133*a* and 133*b*.

The first roller device 240 further includes a plurality of ring members 240*e*, which are provided outside the first and second support portions 133*a* and 133*b*. The plurality of ring members 240*e* may include a first ring member disposed outside the first support portion 133*a* and a second ring member disposed outside the second support portion 133*b*. The first roller shaft 240*c* may penetrate the first and second ring members, and the first and second ring members may guide the first roller shaft 240*c* so as to be firmly supported by the first and second support portions 133*a* and 133*b*.

The second roller device 245 may be coupled to the second roller support portion 153 of the second cover 150. The second roller support portion 153 includes a first support portion 153*a* supporting one side of the second roller device 245, and a second support portion 153*b* supporting the other side of the second roller device 245. The first and second support portions 153*a* and 153*b* may be spaced apart from each other, and a second roller 245*a* of the second roller device 245 may be disposed in the space between the first and second support portions 153*a* and 153*b*.

Specifically, the second roller device 245 includes the second roller 245*a*, a second sliding rail 245*b*, a second roller shaft 245*c*, a second washer 245*d*, and a plurality of ring members 245*e*. The second roller 245*a*, the second sliding rail 245*b*, and the second washer 245*d* may be disposed in the space between the first and second support portions 153*a* and 153*b*, which are spaced apart from each other, and the second roller shaft 245*c* may penetrate the second roller 245*a*, the second sliding rail 245*b*, and the second washer 245*d* and extend in opposite directions of the first and second support portions 153*a* and 153*b*.

The second sliding rail 245*b* may be disposed in the space between the first and second support portions 153*a* and 153*b*, which are spaced apart from each other, and may be disposed so as to be contactable with a side-surface portion of the second rolling guide 115*b*. That is, the second roller 245*a* may be disposed in a rolling manner on the outer peripheral surface of the second rolling guide 115*b*, and the second sliding rail 245*b* may be disposed so as to be contactable with the guide side-surface portion 118, which defines the thickness of the second rolling guide 115*b*. That is, the guide side-surface portion 118 may be provided on each of opposite side surfaces of the rolling guide 115.

A further detailed description related to the components of the second roller device 245 will be replaced with the above description related to the corresponding components of the first roller device 240.

Next, the operation of the second sliding rail 245*b* will be described. Referring to FIG. 8, when the sub drum 110 receives force $F_1$ that causes the sub drum 110 to vibrate in the longitudinal direction during the rotation of the sub drum 110, the force $F_1$ is transferred to the second sliding rail 245*b*. Thereby, counterclockwise torque $T_{r1}$ occurs in the second roller shaft 245*c* with respect to the second support portion 153*b*.

The torque $T_{r1}$ of the second roller shaft 245*c* is transferred to the second roller 245*a*, thus causing the second roller 245*a* to apply pressure to the second rolling guide 115*b*. With the pressure applied by the second roller 245*a*, the sub drum 110 may be prevented from vibrating in the longitudinal direction.

Although only the operation of the second sliding rail 245*b* has been described with reference to FIG. 8, the operation of the second sliding rail 245*b* may also be equally applied to the first sliding rail 240*b*. That is, during the rotation of the sub drum 110, the force that causes the sub drum 110 to vibrate in the longitudinal direction is transferred to the first sliding rail 240*b*. Thereby, counterclockwise torque occurs in the first roller shaft 240*c* with respect to the second support portion 133*b*.

The torque of the first roller shaft 240*c* is transferred to the first roller 240*a*, thus causing the first roller 240*a* to apply pressure to the first rolling guide 115*a*. With the pressure applied by the first roller 240*a*, the sub drum 110 may be prevented from vibrating in the longitudinal direction.

FIG. 9 is a cross-sectional view illustrating the configuration of the drum drive device according to the embodiment of the present invention, and FIG. 10 is a view illustrating the interlocked state of the rack and the gear according to the embodiment of the present invention. The operation of the drum drive device 200 according to the embodiment of the present invention will be described with reference to FIGS. 9 and 10.

When the motor 210 is driven, the rotational speed of the motor 210 may be reduced by the speed reducer 220. Then, the drive force of the motor 210 is transferred to the motor shaft 231 to rotate the motor gear 233. In one example, as illustrated in FIG. 10, the motor gear 233 may be rotated in the clockwise direction.

When the motor gear 233 is rotated, the intermediate gear 235, which is interlocked with the motor gear 233, may be rotated. In one example, as illustrated in FIG. 10, the intermediate gear 235 may be rotated in the counterclockwise direction.

When the intermediate gear 235 is rotated, the rack 114 of the sub drum 110, which is interlocked with the intermediate gear 235, may be rotated. That is, the intermediate gear 235 and the rack 114 may be rotated while being meshed with each other.

When the sub drum 110 is rotated, the first and second roller devices 240 and 245 may guide the stable rotation of the sub drum 110. Specifically, the first roller 240*a* performs rolling along the outer peripheral surface of the first rolling guide 115*a*, and the first sliding rail 240*b* may come into contact with the guide side-surface portion 118 of the first rolling guide 115*a*.

Then, the second roller 245*a* performs rolling along the outer peripheral surface of the second rolling guide 115*b*, and the second sliding rail 245*b* may come into contact with the guide side-surface portion 118 of the second rolling guide 115*b*.

Figure 11:
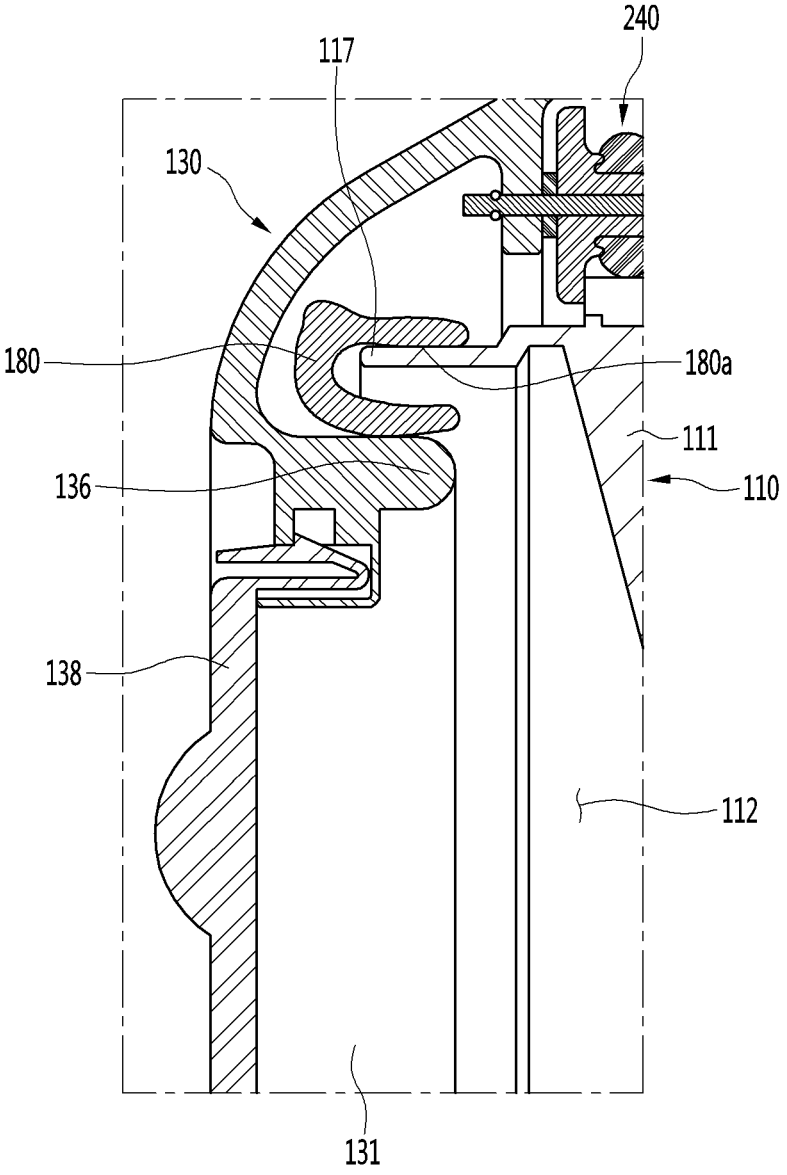
FIG. 11 is a view illustrating the partial configuration of a drum assembly provided with a sealing member according to the embodiment of the present invention.

FIG. 11 is a view illustrating the partial configuration of the drum assembly provided with a sealing member according to the embodiment of the present invention.

Referring to FIG. 11, the clothes dryer 1 according to the embodiment of the present invention further includes a sealing member 180 provided between the sub drum 110 and the first cover 130 to seal the second clothes treatment space 112.

The sealing member 180 may be disposed so as to be coupled to the rear portion 117 of the drum body 111. In one example, the sealing member 180 may include a bonding portion 180*a*, and the bonding portion 180*a* may be bonded to the rear portion 117. Then, the sealing member 180 may be located between the rear portion 117 and the guide rib 136 of the first cover 130 and may function to seal the second clothes treatment space 112.

The sealing member 180 may be formed of felt. Thus, during the rotation of the sub drum 110, the sealing member 180 may slide well relative to the guide rib 136. This may prevent the sealing member 180 from interfering with the rotation of the sub drum 110.

Through the provision of the sealing member 180, it is possible to prevent moisture or a foreign substance (lint) inside the second clothes treatment space 112 from being discharged to the outside of the second clothes treatment space 112 by a negative pressure during the drying operation of the drum assembly 100. In conclusion, it is possible to prevent the moisture or lint from moving to the control panel 17, which is located at the upper side of the drum assembly 100.

Figure 12:
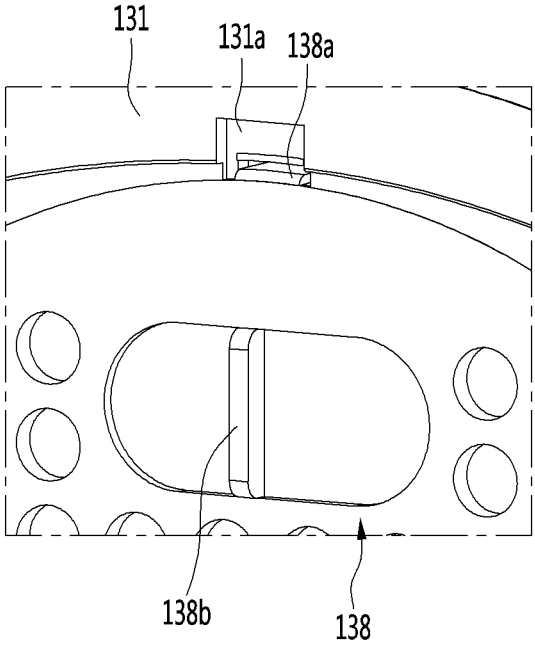
FIG. 12 is a view illustrating the partial configuration of a cover door according to the embodiment of the present invention.
Figure 13:
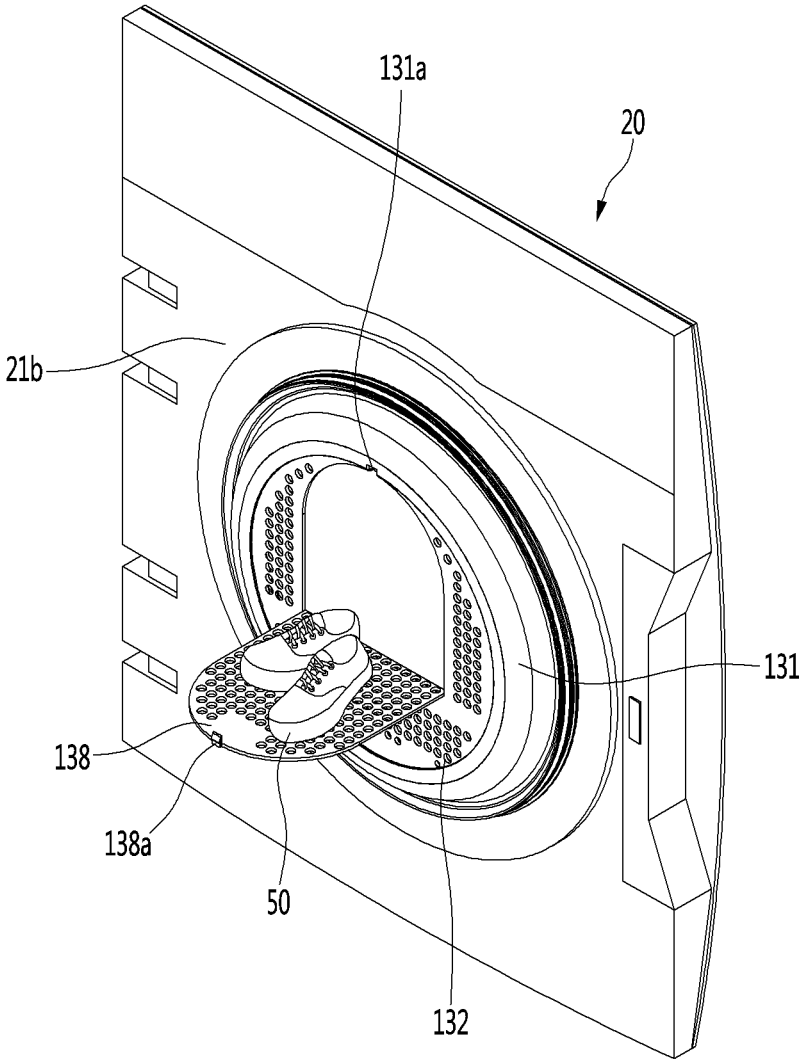
FIG. 13 is a view illustrating the state in which shoes are placed on the cover door according to the embodiment of the present invention.

FIG. 12 is a view illustrating the partial configuration of the cover door according to the embodiment of the present invention, and FIG. 13 is a view illustrating the state in which shoes are placed on the cover door according to the embodiment of the present invention.

Referring to FIGS. 12 and 13, the drum assembly 100 according to the embodiment of the present invention may be used to dry shoes 50.

The drum assembly 100 includes the first cover 130 having the cover door 138 to be openable. Specifically, the first cover 130 may include the first cover body 131 and the cover door 138 rotatably coupled to the first cover body 131. In one example, the cover door 138 may be configured in a pull-down manner so as to be opened by downward rotation of the upper portion thereof with respect to the lower portion thereof.

The first cover 130 further includes a plurality of protrusions 138*a* and 138*b*, which may be operated by the user. The plurality of protrusions 138*a* and 138*b* include a first protrusion 138*a* and a second protrusion 138*b* provided on the cover door 138.

The first protrusion 138*a* may be understood as a holding protrusion, which is provided on the upper end of the cover door 138 and is caught by a protrusion holder 131*a* of the first cover body 131. The second protrusion 138*b* may be understood as an operation protrusion, which is provided on the cover door 138 at a position below the first protrusion 138*a* and may be operated by the user.

In one example, the user may open the cover door 138 by pushing the first protrusion 138*a* with his/her index finger while gripping the second protrusion 138*b* with his/her thumb and middle finger.

When the first protrusion 138*a* is released from the first cover body 131, the cover door 138 may rotate downward to thereby be opened. In one example, the cover door 138 may rotate downward by about 90 degrees to thereby be opened.

The user may place the shoes 50 on the inner surface of the cover door 138. That is, the inner surface of the cover door 138 may form a pedestal for the drying of clothes. Then, when the door 20 is closed, the shoes 50 may be positioned inside the main drum 4. In this way, in the state in which the shoes 50 are placed on the cover door 138, the clothes dryer 1 may be operated to dry the shoes 50.

According to the present invention, since clothes may be separated and dried using a sub drum, there is an advantage in that drying of specific clothes may be efficiently performed. In addition, the overall drying capacity of a clothes dryer may be increased.

In addition, since a change in the position of clothes introduced into the sub drum may be realized via rotation of the sub drum, the drying efficiency of clothes may be enhanced. In particular, the rotation of the sub drum may be easily realized with the structure of a motor, a gear, and a rack.

In addition, since the sub drum may be stably supported by first and second covers, which are provided at opposite sides of the sub drum, it is possible to reduce vibrations or noises generated during the rotation of the sub drum.

In addition, since roller devices provided on the first and second covers are contactable with the outer peripheral surface of the sub drum, the sub drum may be stably rotated and may be prevented from deviating from a rotation path during the rotation thereof.

In addition, through the provision of a sealing member between the sub drum and the cover, it is possible to prevent lint or moisture inside the sub drum from leaking to the outside through a space between the sub drum and the cover.

In addition, drying of shoes may be performed in the state in which the shoes are placed on a cover door of the first cover.

What is claimed is:

1. A clothes dryer comprising:

a casing having a first drum disposed therein, the casing comprising an introduction opening configured to receive an article of clothing therethrough;

a door attached to the casing and having an opening formed therein, the door being movable between a closed position in which the door closes the introduction opening and an open position in which access can be had through the introduction opening to an interior volume of the first drum;

a drum assembly disposed within the opening, wherein the drum assembly comprises:

a second drum that is rotatable;

a first cover disposed at a first side of the second drum, the first cover having a first roller device to guide rotation of the second drum; and a second cover disposed at a second side of the second drum, the second cover having a second roller device to guide the rotation of the second drum, wherein the first roller device and the second roller device are provided to be in contact with an outer peripheral surface of the second drum.

2. The clothes dryer of claim 1, further comprising a clothes treatment space formed by an inner space of the second drum and the first cover.

3. The clothes dryer of claim 2, wherein the first cover comprises:

a first cover body having a through-hole; and a cover door coupled to the first cover body, the cover door being movable between a closed position in which the cover door closes access to the clothes treatment space and an open position in which access can be had to the clothes treatment space, wherein the clothes treatment space is in communication with an inner space of the first drum through the through hole.

4. The clothes dryer of claim 3, wherein the first cover body and the cover door are each formed of a transparent material.

5. The clothes dryer of claim 3, wherein the first cover body further comprises a first roller support portion to support the first roller device, and wherein the first roller device comprises a plurality of first roller devices disposed on the first roller support portion, the plurality of first roller devices being spaced apart from each other in a circumferential direction.

6. The clothes dryer of claim 2, wherein the second drum comprises a drum body having a cylindrical shape and comprising a rear portion that is opened, and wherein the first cover is coupled to the rear portion.

7. The clothes dryer of claim 6, wherein the drum body and a front-surface portion of the door are each formed of a transparent material.

8. The clothes dryer of claim 6, further comprising a drum driver that provides the second drum with a rotational force, the drum driver comprising a motor and at least one gear member.

9. The clothes dryer of claim 8, further comprising a rack provided on an outer peripheral surface of the drum body and interlocked with the at least one gear member.

10. The clothes dryer of claim 9, further comprising a rolling guide provided on the outer peripheral surface of the drum body, the rolling guide being contactable with the first and second roller devices, wherein the rolling guide is disposed at opposite sides of the rack.

11. The clothes dryer of claim 10, wherein the first roller device or the second roller device comprises:

a roller to roll on an outer peripheral surface of the rolling guide;

a roller shaft coupled to the roller; and a sliding rail coupled to the roller shaft, the sliding rail being contactable with a guide side-surface portion that defines a thickness of the rolling guide.

12. The clothes dryer of claim 11, wherein the first cover or the second cover comprises two roller support portions to accommodate therein the roller and the sliding rail, and wherein the roller shaft penetrates the roller and the sliding rail and extends in opposite directions of the two roller support portions.

13. The clothes dryer of claim 1, wherein the second cover surrounds an outer peripheral surface of the second drum, and wherein the second roller device is disposed on an inner peripheral surface of the second cover.

14. The clothes dryer of claim 13, wherein the second cover comprises a gear accommodating portion having an intermediate gear inserted therein to guide the rotation of the second drum, and wherein the intermediate gear comprises an upper portion that is interlocked with a rack provided on the second drum.

15. The clothes dryer of claim 6, further comprising a sealing member coupled to the opened rear portion of the second drum and configured to seal the clothes treatment space.

16. The clothes dryer of claim 3, further comprising a protrusion provided on an upper portion of the cover door and configured to be received by the cover body, wherein the cover door is a pull-down opening door configured to be opened by a downward rotation of the upper portion of the cover door with respect to a lower portion of the cover door.

17. A clothes dryer comprising:

a casing having a main drum disposed therein, the casing being comprising an introduction opening configured to receive an article of clothing therethrough;

a door attached to the casing and having an opening formed therein, the door being movable between a closed position in which the door closes the introduction opening and an open position in which access can be had through the introduction opening to an interior volume of the main drum; and a drum assembly disposed within the opening, wherein the drum assembly comprises:

a sub drum that is rotatable;

a first cover provided between the sub drum and the main drum, and comprising a through-hole, the main drum is in communication with the sub drum through the through-hole;

a drum drive device comprising a motor to provide the sub drum with a rotational force; and a power transmission device provided on the sub drum and in communication with the motor, wherein the first cover includes a cover door being movable between a closed position in which the cover door closes access to an inside of the sub drum and an open position in which access can be had to the inside of the sub drum.

18. The clothes dryer of claim 17, wherein the drum drive device further comprises a gear coupled to the motor, and wherein the power transmission device comprises a rack that is interlocked with the gear.

19. The clothes dryer of claim 18, further comprising a roller device provided on the first cover, the roller device being contactable with an outer peripheral surface of the sub drum.

20. The clothes dryer of claim 17, further comprising a second cover that surrounds an outer peripheral surface of the sub drum and provided with a roller device.

* * * * *